US011415361B2

(12) United States Patent
Liang et al.

(10) Patent No.: US 11,415,361 B2
(45) Date of Patent: Aug. 16, 2022

(54) REFRIGERATOR BOX BODY AND REFRIGERATOR

(71) Applicants: HEFEI HUALING CO., LTD., Anhui (CN); HEFEI MIDEA REFRIGERATOR CO., LTD., Anhui (CN); MIDEA GROUP CO., LTD., Guangdong (CN)

(72) Inventors: Benlei Liang, Anhui (CN); Chao Liu, Anhui (CN); Pingfang Li, Anhui (CN); Huawei Zhang, Anhui (CN); Hao Yu, Anhui (CN)

(73) Assignees: HEFEI HUALING CO., LTD., Anhui (CN); HEFEI MIDEA REFRIGERATOR CO., LTD., Anhui (CN); MIDEA GROUP CO., LTD., Guangdong (CN)

( * ) Notice: Subject to any disclaimer, the term of this patent is extended or adjusted under 35 U.S.C. 154(b) by 125 days.

(21) Appl. No.: 16/967,122

(22) PCT Filed: Oct. 23, 2018

(86) PCT No.: PCT/CN2018/111304
§ 371 (c)(1),
(2) Date: Aug. 3, 2020

(87) PCT Pub. No.: WO2019/091279
PCT Pub. Date: May 16, 2019

(65) Prior Publication Data

US 2021/0381750 A1 Dec. 9, 2021

(30) Foreign Application Priority Data

Nov. 13, 2017 (CN) ..... 201721510145.1

(51) Int. Cl.
*F25D 23/02* (2006.01)
*E05D 5/06* (2006.01)

(52) U.S. Cl.
CPC ..... *F25D 23/028* (2013.01); *E05D 5/065* (2013.01); *E05Y 2900/31* (2013.01); *F25D 2323/024* (2013.01)

(58) Field of Classification Search
CPC . F25D 23/028; F25D 2323/024; E05D 5/065; E05Y 2900/31; E05Y 2900/306
See application file for complete search history.

(56) References Cited

U.S. PATENT DOCUMENTS 3,001,226 A * 9/1961 Squire ..... E05F 1/1261 16/290
6,766,563 B2 * 7/2004 Lee ..... A23B 7/0425 16/281
2012/0037642 A1 * 2/2012 Sun ..... E05D 7/0027 220/592.02

FOREIGN PATENT DOCUMENTS

CN 101482357 A 7/2009
CN 101512272 A 8/2009
(Continued)

*Primary Examiner* — Andrew M Roersma
(74) *Attorney, Agent, or Firm* — Seed IP Law Group LLP

(57) ABSTRACT

A refrigerator box body includes mounting bases (1) used to mount hinges, a box housing (2) provided with an upward opening, and an opening frame (3) connected to the opening of the box housing (2), a side plate of the box housing (2) being provided with mounting ports (4) penetrating the side plate of the box housing (2) along the thickness direction, the mounting bases (1) being arranged within the mounting ports (4), the mounting bases (1) being provided with depressions (11) with concave sides toward an inside of the box housing (2), the hinges being mounted within the depressions (11), the mounting bases (1) being provided with guide grooves (12), side edges of the mounting ports
(Continued)

(4) being inserted into the guide grooves (12) so as to connect the mounting bases (1) and the box housing (2), an edge of the opening frame (3) abutting against upper sides of the mounting bases (1).

20 Claims, 11 Drawing Sheets

(56) References Cited

FOREIGN PATENT DOCUMENTS

| | | | | |
|---|---|---|---|---|
| CN | 101839609 | A | | 9/2010 |
| CN | 102494491 | A | | 6/2012 |
| CN | 106940107 | A | | 7/2017 |
| CN | 106979655 | A | | 7/2017 |
| CN | 207515318 | U | | 6/2018 |
| JP | H03111876 | U | | 11/1991 |
| JP | H1078282 | A | | 3/1998 |
| KR | 20110072704 | A | * | 6/2011 |
| KR | 101653316 | B1 | * | 9/2016 |

* cited by examiner

REFRIGERATOR BOX BODY AND REFRIGERATOR

FIELD

The present application relates to the technical field of household appliances, in particular to a refrigerator box body and a refrigerator.

BACKGROUND

With the development of the society, the utilization rate of the refrigerator is higher and higher, the hinge design of the traditional refrigerator all adopts the way of external hanging, the hinges protrude the box body, when the packing box packs the refrigerator, the packing box needs to be bigger than the protrusion part of the hinges, therefore, there is a certain gap between the refrigerator box body and the packing box, which reduces the loading quantity of the products and increases the freight cost of the products.

In view of the above-mentioned defects, it is necessary to provide a new refrigerator box body.

SUMMARY

The present application mainly aims to provide a refrigerator box body and aims to solve the problem that the transportation cost is increased due to the convex hinges of the existing refrigerator box body.

In order to achieve the above object, the refrigerator box body provided by the application comprises mounting bases used to mount hinges, a box housing provided with an upward opening, and an opening frame connected to the opening of the box housing, a side plate of the box housing is provided with mounting ports penetrating the side plate of the box housing along the thickness direction, the mounting bases are arranged within the mounting ports, the mounting bases are provided with depressions with concave sides toward an inside of the box housing, the hinges are mounted within the depressions, the mounting bases are provided with guide grooves, side edges of the mounting ports being inserted into the guide grooves to connect the mounting bases and the box housing, an edge of the opening frame abutting against upper sides of the mounting bases.

Optionally, the mounting bases comprise a mounting housing and mounting plates provided on left and right sides of the mounting housing, the depressions are provided on the mounting housing, the guide grooves are provided in the mounting plates, and side edges of the mounting ports are inserted into the guide grooves to connect the mounting bases and the box housing.

Optionally, a plurality of boss structures provided at intervals are provided in the guide grooves, the boss structures are provided in the mounting plates, the length direction of the boss structures are consistent with the height direction of the guide grooves, and protrusions of the boss structures face away from the inside of the box housing.

Optionally, the mounting bases further comprise a plurality of clamping plates provided at the lower side of the mounting bases, a plurality of slots are provided in the clamping plates, and the lower edges of the mounting ports are inserted into the slots.

Optionally, an plurality of inverted buckles are provided in the slots, and a plurality of clamping holes which are clamped with the inverted buckles are provided on the lower edges of the mounting ports.

Optionally, the opening frame is opened with notches facing the mounting ports, both sides of the notches extend downward to form wrappings, and the wrappings cover the upper sides of the mounting bases.

Optionally, the box body further comprises a plurality of screw plates connected to the mounting bases, the screw plates are provided opposite to the hinges, and the mounting bases are arranged between the screw plates and the hinges.

Optionally, two oppositely provided positioning grooves are provided on the surfaces of the mounting bases facing the screw plates, and the screw plates are inserted into the two positioning grooves.

Optionally, a plurality of buckles are further provided on the surface of the mounting bases facing the screw plates, the buckles and the two positioning grooves are provided at intervals, and the screw plates are clamped on the buckles.

In addition, the application also provides a refrigerator, the refrigerator comprises a door body, a plurality of hinges and a refrigerator box body as claimed in any preceding claims which is connected with the door body, and the hinges are mounted on the mounting bases.

In the technical solution of this application, a side plate of the box housing is provided with mounting ports penetrating the side plate of the box housing along the thickness direction, the mounting bases are arranged within the mounting ports, the mounting bases are provided with depressions with concave sides toward an inside of the box housing, the hinges are mounted within the depressions, the mounting bases are provided with guide grooves, side edges of the mounting ports being inserted into the guide grooves to connect the mounting bases and the box housing, an edge of the opening frame abutting against upper sides of the mounting bases. The box housing of the refrigerator box body adopts a design of depression, the mounting bases are mounted in the side plate of the box housing, and the hinges are mounted in the depressions of the mounting bases, so that the space on the outer surface of the box housing occupied by the hinges after being mounted on the mounting bases is reduced, the loading quantity of products is improved, and the transportation cost is reduced; meanwhile, the mounting bases are inserted into the side edges of the mounting ports through the guide grooves, so that the mounting is convenient. In addition, the edge of the opening frame abuts against the upper side of the mounting bases, the opening frame is pressed above the mounting bases, and the connection among the mounting bases, the box housing and the opening frame is more stable by utilizing the stress during foaming.

BRIEF DESCRIPTION OF THE DRAWINGS

In order to more clearly illustrate the embodiments of the present application or the technical solutions in the prior art, the drawings used in the description of the embodiments or the prior art will be briefly described as follows. Obviously, the drawings in the following description are only some embodiments of the present application, and that a person skilled in the art can obtain other drawings from the structures shown in these drawings without involving any inventive effort.

Numerals in the drawings.

TABLE 1

Figure 1:
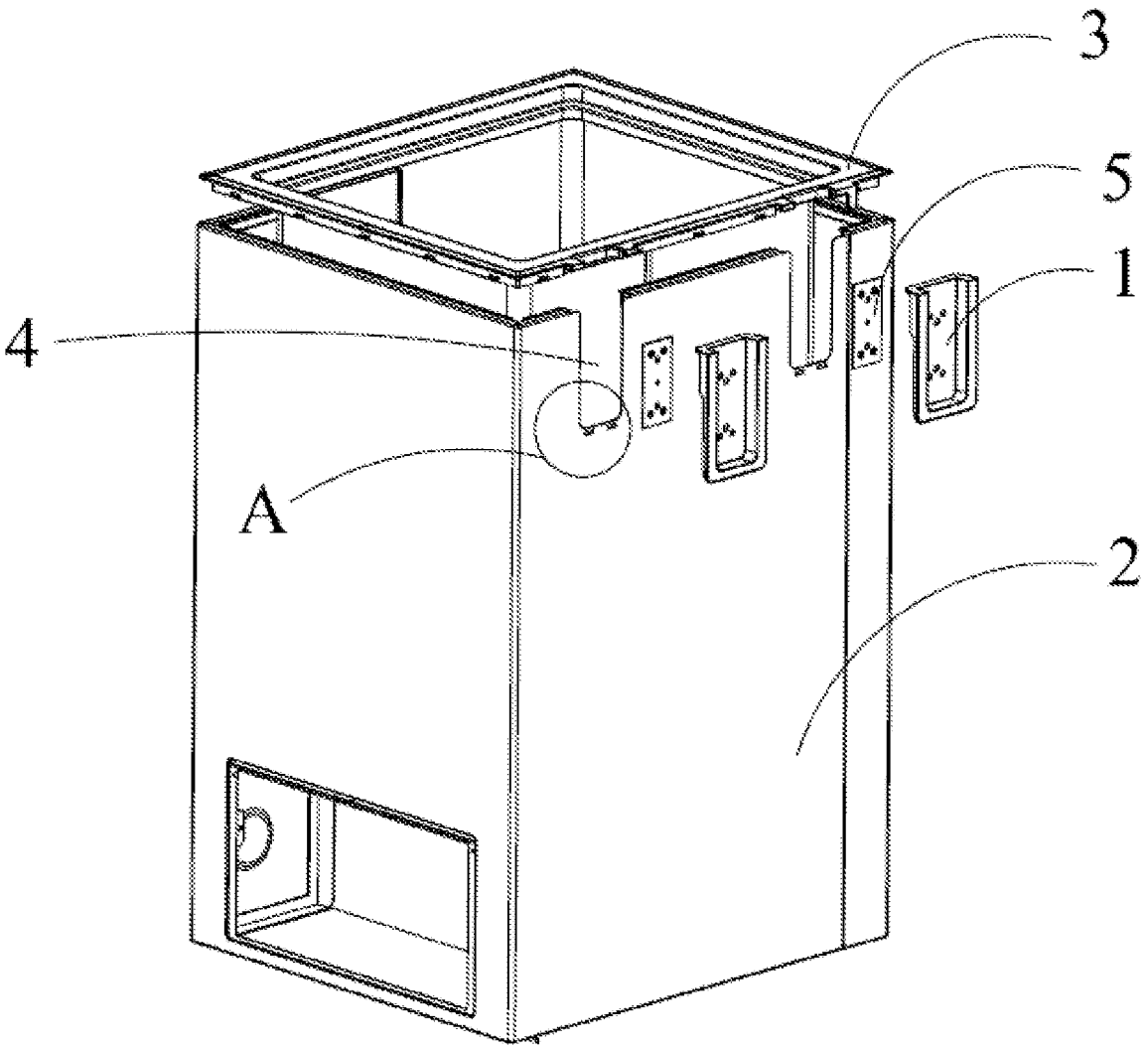
FIG. 1 is an exploded view of a box housing assembly in an embodiment of the present application.

| Numeral | Name | Numeral | Name |
|---|---|---|---|
| 1 | mounting bases | 11 | depressions |
| 12 | guide grooves | 121 | boss structures |
| 13 | mounting housing | 14 | mounting plates |
| 15 | clamping plates | 151 | slots |
| 152 | inverted buckles | 16 | through hole |
| 17 | positioning grooves | 18 | buckles |
| 2 | box housing | 3 | opening frame |
| 31 | wrappings | 4 | mounting ports |
| 41 | clamping holes | 5 | screw plates |

The accomplishment, functional features and advantages of the objects of the present application will be further described with reference to the embodiments, and with reference to the accompanying drawings.

DETAILED DESCRIPTION OF THE DISCLOSURE

The technical solutions in the embodiments of the present application will be described clearly and completely with reference to the drawings in the embodiments of the present application. Obviously, the described embodiments are only a part of the embodiments of the present application, but not all the embodiments. Based on the embodiments in the present application, all other embodiments obtained by a person skilled in the art without involving any inventive effort are within the scope of protection of the present application.

It should be noted that all directional indications (such as upper, lower, left, right, front, and rear . . . ) in the embodiments of the present application are used only to explain the relative position relationships, motion conditions, etc. between components in a particular pose (as shown in the figures), if the particular pose changes, the directivity indication changes accordingly.

In addition, descriptions such as those relating to "first, second", etc. in this application are for descriptive purposes only and are not to be construed as indicating or implying relative importance or implicitly indicating the number of technical features indicated. Thus, features defined with "first" and "second" may explicitly or implicitly comprise at least one such feature. In the description of the present application, "plurality" means at least two, e.g., two, three, etc., unless specifically defined otherwise.

In this application, the terms "connected", "secured", and the like are to be construed broadly, unless expressly stated and defined otherwise, e.g., "secured" can be fixedly connected, or may be detachably connected, or integrated; can be a mechanically connected or an electrically connected; can be joined directly or indirectly through intermediary, can be a communication within two elements or an interaction between two elements, unless expressly defined otherwise. The specific meaning of the above terms in this application will be understood by those of ordinary skill in the art, as the case may be.

In addition, the technical solutions of the various embodiments of the present application can be combined with each other, but they must be based on the realization by those of ordinary skill in the art, and when the combination of the technical solutions contradicts each other or cannot be realized, it should be considered that such a combination of technical solutions does not exist, nor is it within the scope of protection claimed in this application.

The application provides a refrigerator box body and aims to solve the problem that the transportation cost is increased due to the convex hinges of the existing refrigerator box body.

Figure 5:
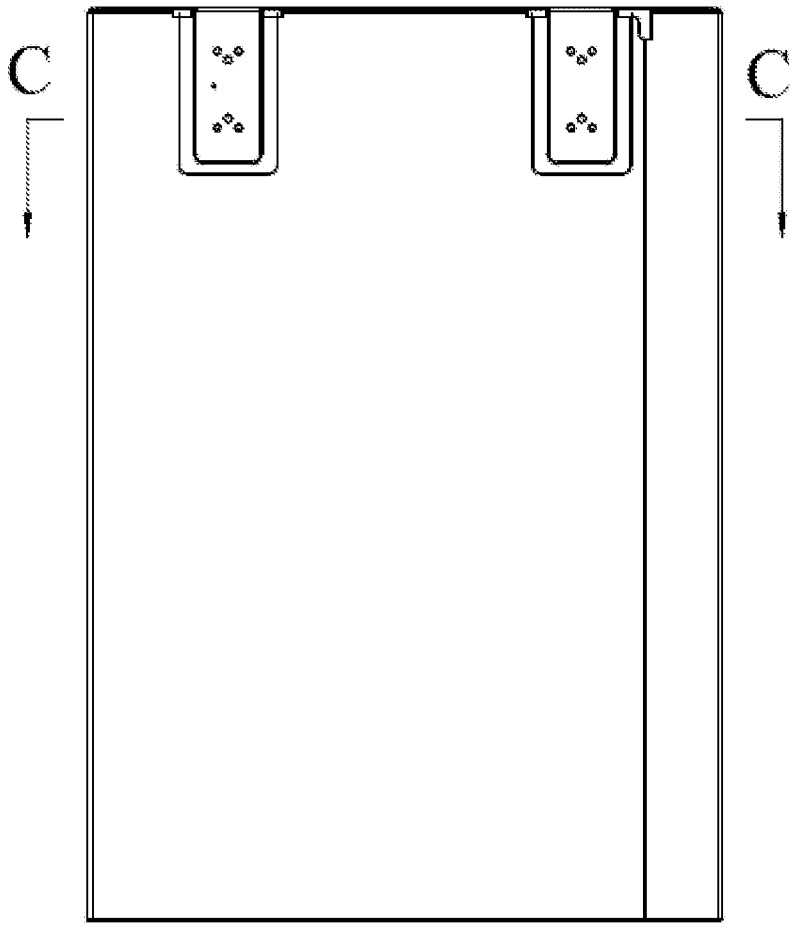
FIG. 5 is a schematic view showing the structure of the box housing assembly from another perspective in the embodiment of the present application.
Figure 9:
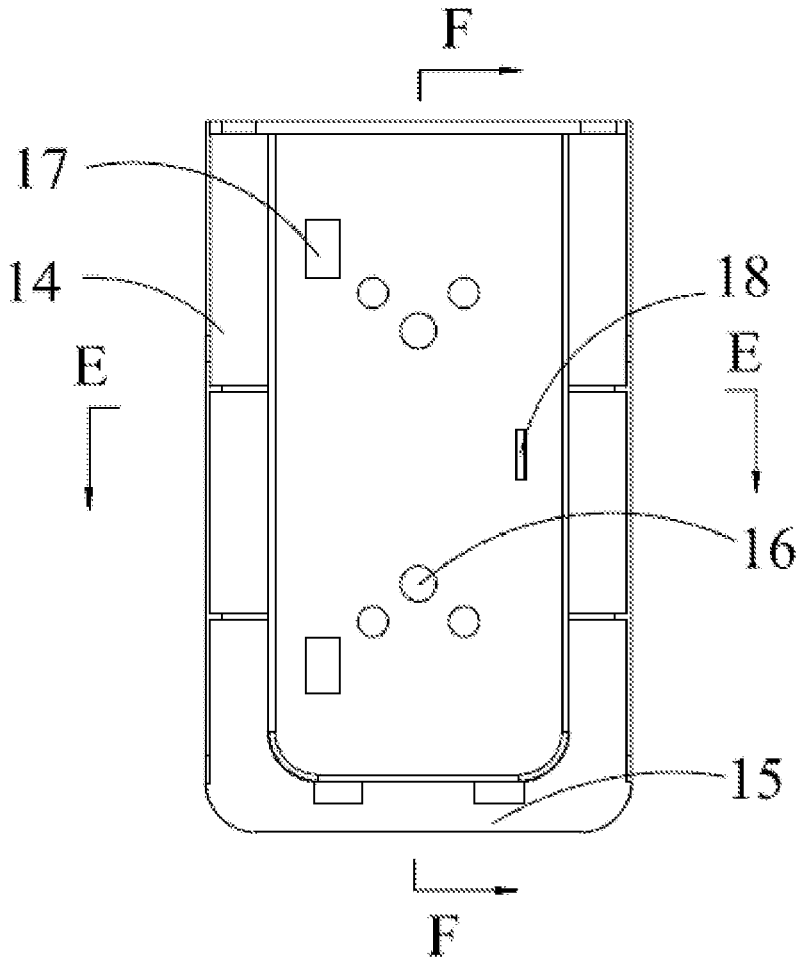
FIG. 9 is a schematic view showing the structure of the mounting bases from another perspective in the embodiment of the present application.
Figure 10:
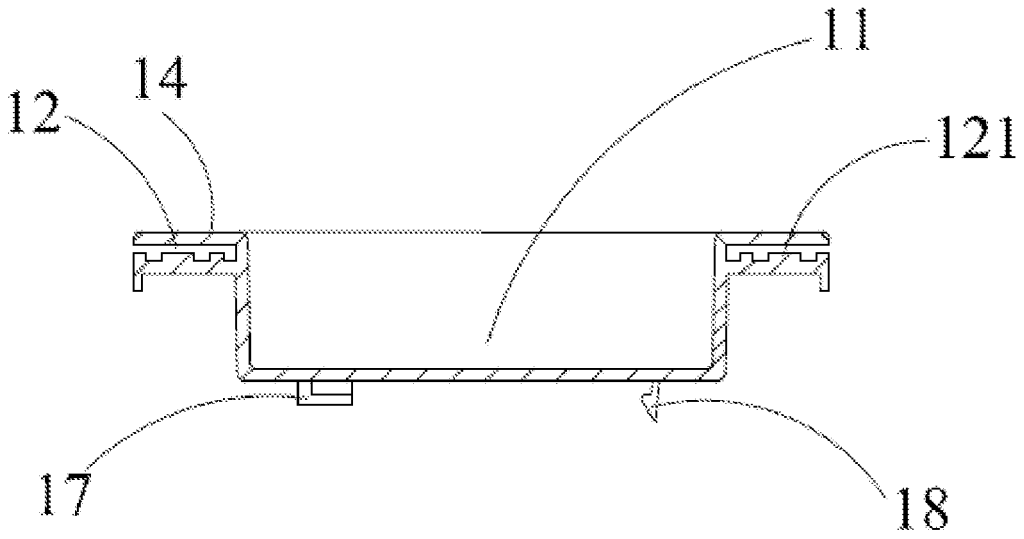
FIG. 10 is a cross-sectional view along E-E of FIG. 9.

In this application, references to "left", "right", "upper", "lower", etc. refer to directions and relative positional relationships of components as shown in FIG. 5. Referring to FIGS. 1, 9 and 10, in one embodiment of the present application, a refrigerator box body, comprising mounting bases 1 used to mount hinges (not shown), a box housing 2 provided with an upward opening, and an opening frame 3 connected to the opening of the box housing 2, a side plate of the box housing 2 being provided with mounting ports 4 penetrating the side plate of the box housing 2 along the thickness direction, the mounting bases 1 being arranged within the mounting ports 4, the mounting bases 1 being provided with depressions 11 with concave sides toward an inside of the box housing 2, the hinges being mounted within the depressions 11, the mounting bases 1 being provided with guide grooves 12, side edges of the mounting ports 4 being inserted into the guide grooves 12 so as to connect the mounting bases 1 and the box housing 2, an edge of the opening frame 3 abutting against upper sides of the mounting bases 1.

The box housing of the refrigerator box body adopts a design of depression, the mounting bases are mounted in the side plate of the box housing, and the hinges are mounted in the depressions of the mounting bases, so that the space on the outer surface of the box housing occupied by the hinges after being mounted on the mounting bases are reduced, the loading quantity of products is improved, and the transportation cost is reduced; meanwhile, the mounting bases are inserted into the side edges of the mounting ports through the guide grooves, so that the mounting is convenient. In addition, the edge of the opening frame abuts against the upper side of the mounting bases, the opening frame is pressed above the mounting bases, and the connection among the mounting bases, the box housing and the opening frame is more stable by utilizing the stress during foaming.

Figure 3:
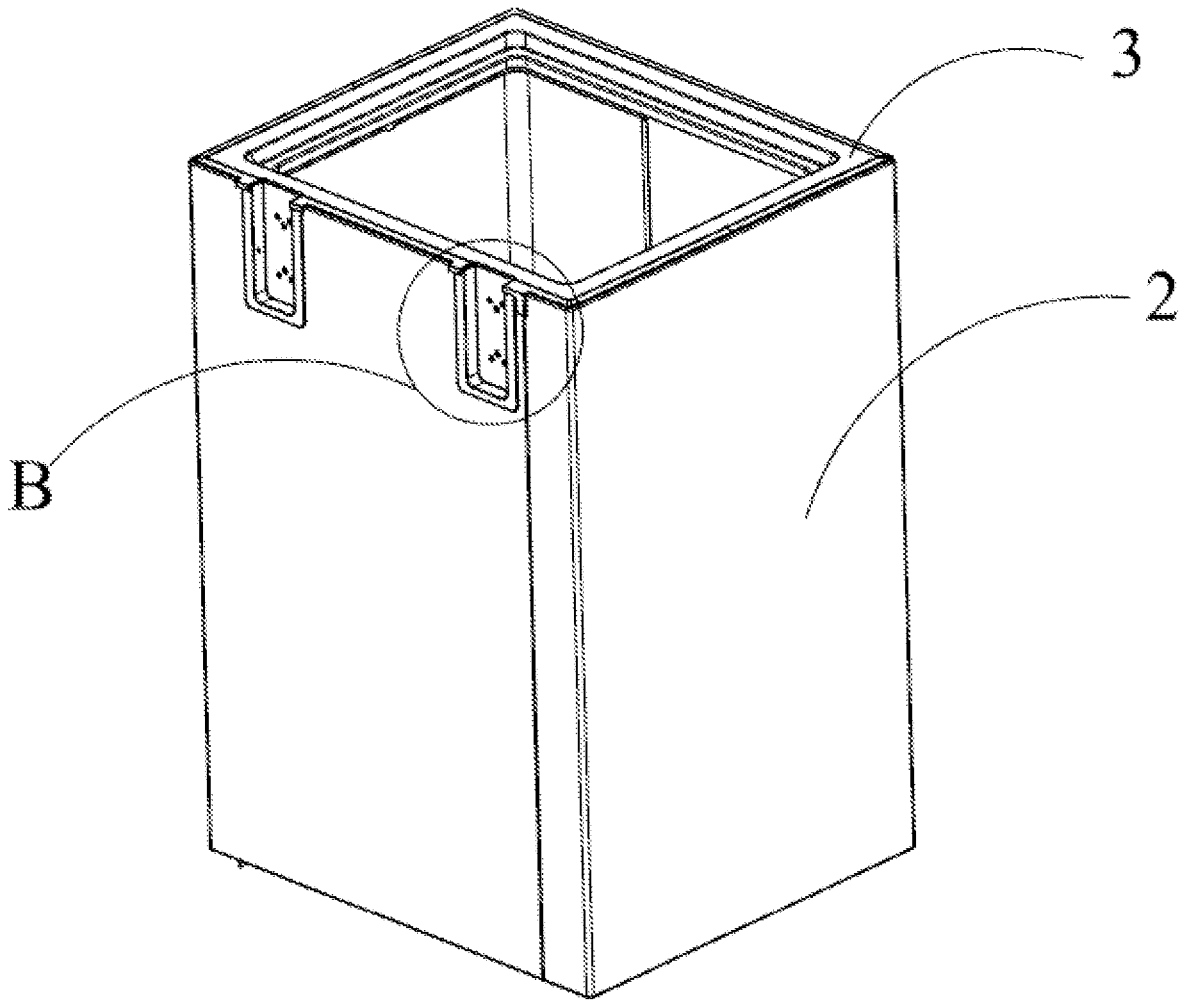
FIG. 3 is a schematic view showing the structure of the box housing assembly from one perspective in the embodiment of the present application.

Wherein, with reference to FIG. 3, a plurality of mounting ports 4 can be provided on the side plates of the box housing 2, a plurality of mounting bases 1 and a plurality of hinges are also provided, the door body and the box housing 2 are hinged through the hinges respectively provided on the mounting bases, and the stability of the door body during opening and closing is effectively guaranteed. In a preferred embodiment, the number of the mounting ports 4 is two, and the mounting ports 4 are oppositely provided on the rear side plate of the box housing 2, so that the stability can be guaranteed through the two hinges when the door body is opened and closed, and the production cost of products is reduced.

Figure 6:
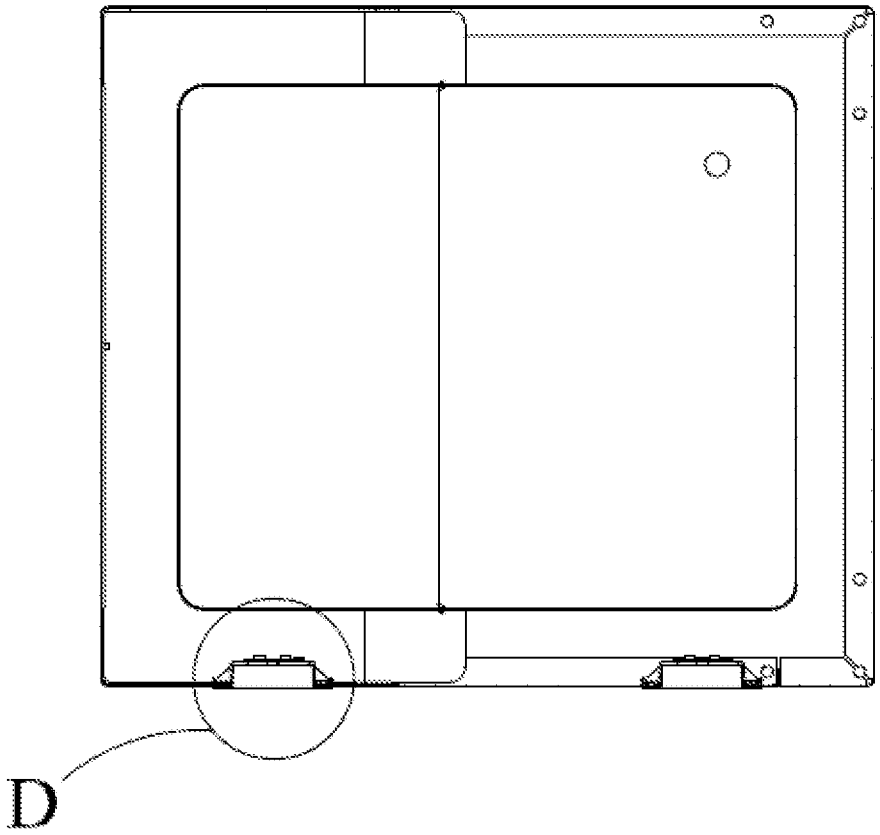
FIG. 6 is a cross-sectional view along C-C of FIG. 5.
Figure 7:
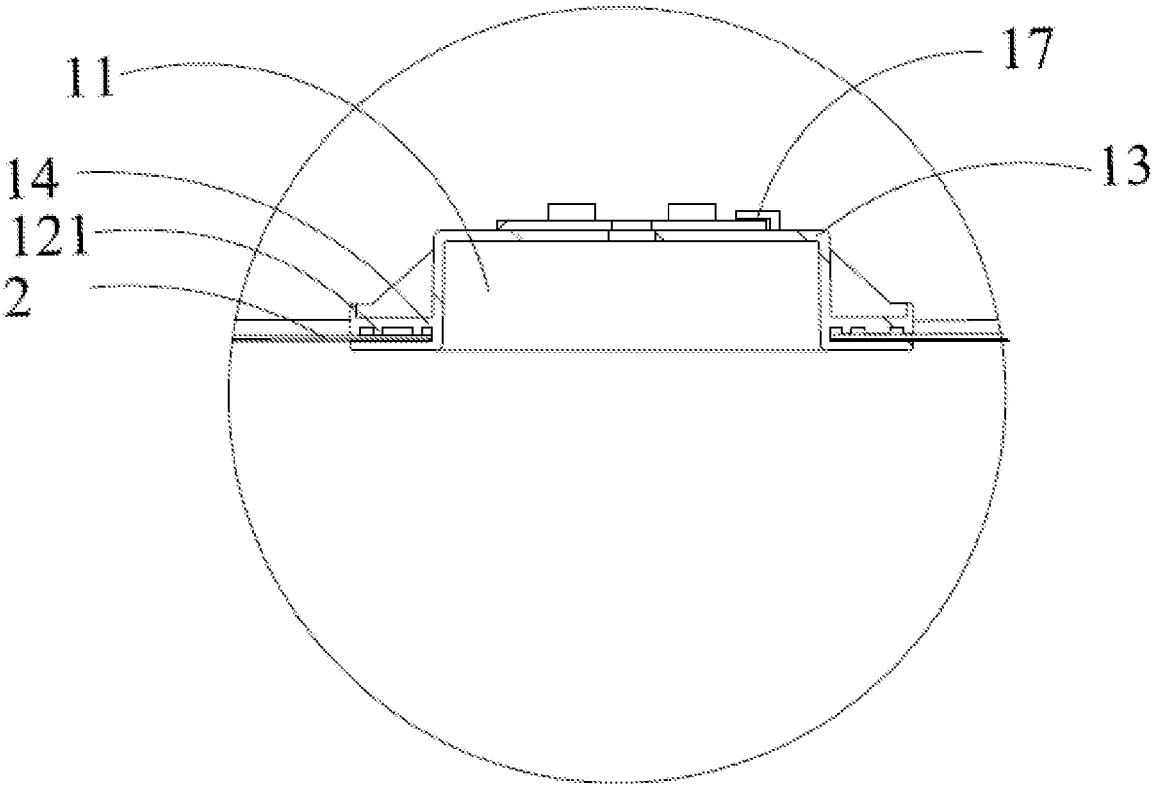
FIG. 7 is an enlarged view of portion D of FIG. 6.

Referring to FIGS. 5 to 7, the mounting bases 1 includes a mounting housing 13 on which the depressions 11 are provided, and mounting plates 14 provided at left and right sides of the mounting housing 13, guide grooves 12 provided in the mounting plates 14, and side edges of the mounting ports 4 are inserted into the guide grooves 12 for connecting the mounting bases 1 and the box housing 2. The mounting bases 1 are inserted into the side edge of the mounting ports 4 through the guide grooves 12, so that the mounting is convenient and fast; the guide grooves 12 are provided on the mounting plates 14 on the left side and the right side of the mounting housing 13 to position the mounting position of the mounting bases 1, so that the phenomenon that the hinges are mounted to deviate to one side due to the fact that the mounting bases 1 deviates to one side during mounting is avoided, and the quality of a refrigerator product is improved.

Referring to FIG. 10, a plurality of boss structures 121 are provided in the guide grooves 12 at intervals, the boss structures 121 are provided in the mounting plates 14, the length direction of the boss structures 121 are consistent with the height direction of the guide grooves 12, and the protrusions of the boss structures 121 face away from the inside of the box housing 2. When the mounting bases 1 are inserted into the side edges of the mounting ports 4, the boss structures 121 abuts against the side edges of the mounting ports 4 inserted into the guide grooves 12, and by arranging the boss structures 121, the contact area between the mounting plates 14 and the side edges of the mounting ports 4 is reduced, thereby further facilitating the mounting of the mounting bases 1.

Figure 11:
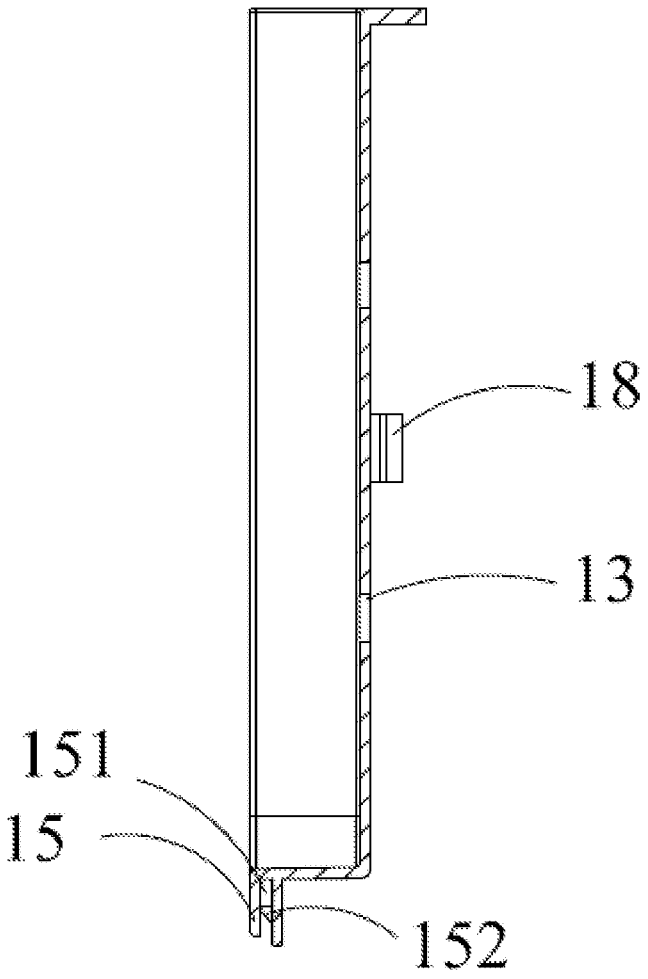
FIG. 11 is a cross-sectional view along F-F of FIG. 9.

Further, referring to FIGS. 9 and 11, the mounting bases 1 further includes a plurality of clamping plates 15 provided at the lower side of the mounting bases, a plurality of slots 151 are provided in the clamping plates 15, and the lower edges of the mounting ports 4 are inserted into the slots 151. The mounting position of the mounting bases 1 are further positioned through the cooperation of the slots 151 and the lower edges of the mounting ports 4, and accurate mounting of the mounting bases 1 is ensured.

Figure 2:
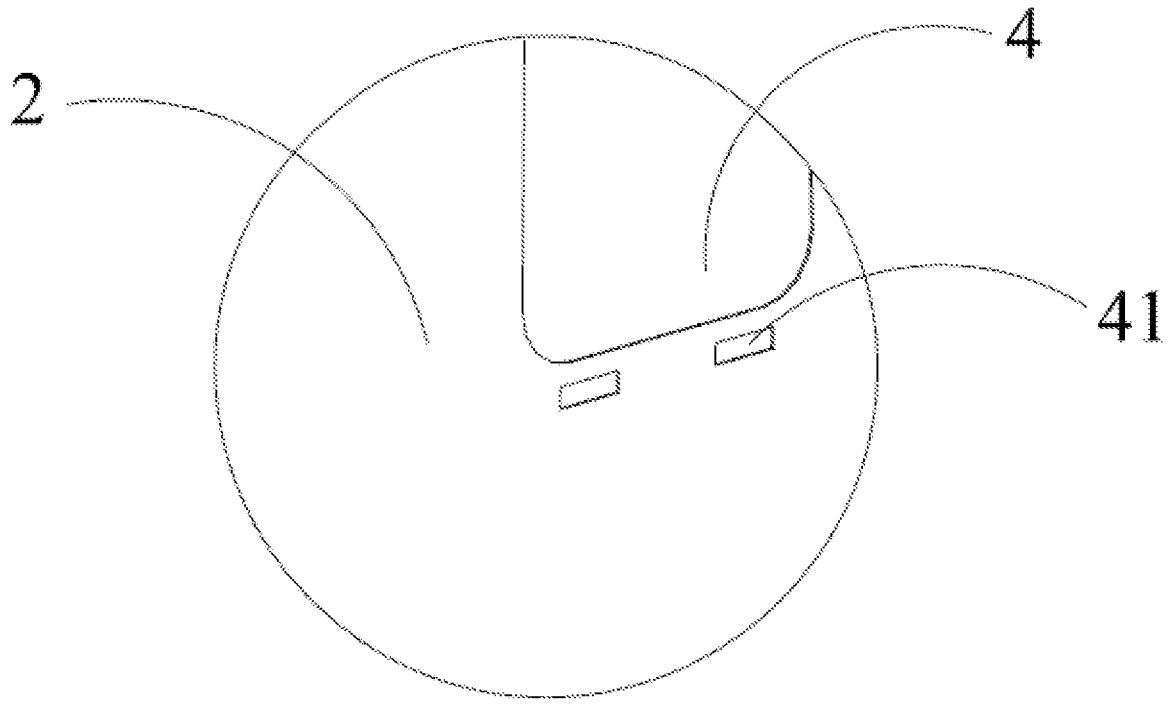
FIG. 2 is an enlarged view of portion A of FIG. 1.

In addition, referring to FIGS. 2 and 11, a plurality of inverted buckles 152 are provided in the slots 151, and a plurality of clamping holes 41 for clamping with the inverted buckles 152 are provided on the lower edges of the mounting ports 4. After the mounting bases 1 is mounted on the box housing 2, the inverted buckles 152 on the mounting bases 1 are clamped on the clamping holes 41 on the lower edges of the mounting ports 4, so that the mounting stability of the mounting bases 1 and the box housing 2 is improved, and the mount positioning accuracy of the mounting bases 1 and the box housing 2 is further improved. Wherein, the clamping holes 41 may be provided in a plurality as required, and in a preferred embodiment, the clamping holes 41 are provided in two to further improve mounting stability.

Figure 4:
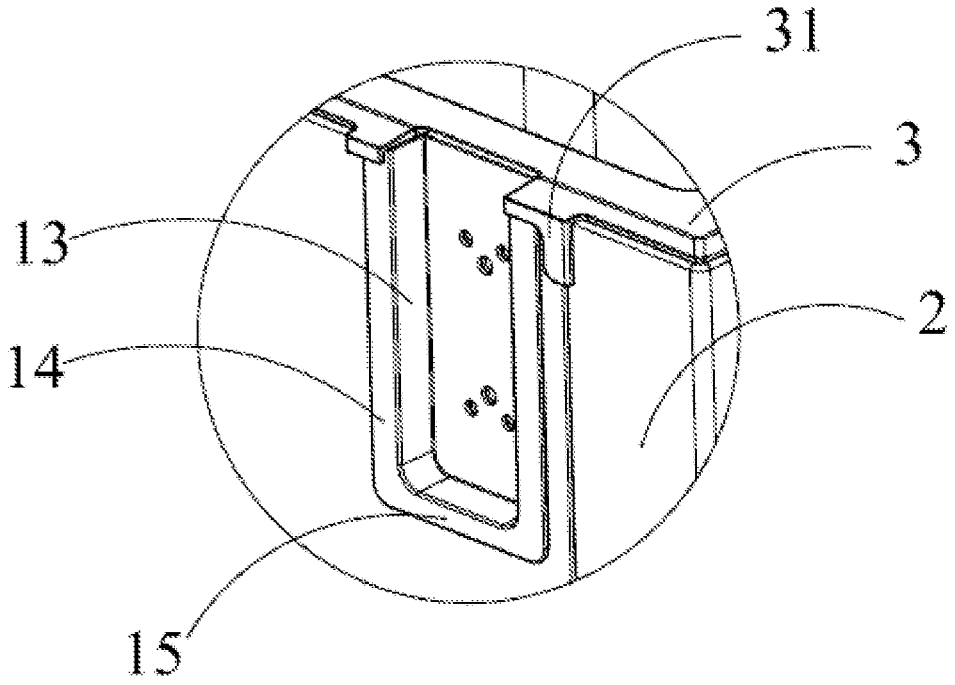
FIG. 4 is an enlarged view of portion B of FIG. 3.

Further, referring to FIGS. 3 and 4, the opening frame 3 is opened with notches facing the mounting ports 4, both sides of the notches extend downward to form wrappings 31, and the wrappings 31 cover the upper sides of the mounting bases 1. The opening frame 3 is opened with notches which are opposite to the mounting ports 4, so that interference between the hinges and the opening frame 2 when the hinges are mounted is avoided, and smooth mounting of the hinges are ensured; the wrappings 31 covers the upper side of the mounting bases 1, the edge of the opening frame 3 abuts against the upper side of the mounting bases 1, the opening frame is pressed above the mounting bases, and the connection among the mounting bases, the box housing and the opening frame is more stable by utilizing the stress during foaming.

In addition, referring to FIG. 1, the refrigerator box body further comprises a plurality of screw plates 5 connected to the mounting bases 1, the screw plates 5 are provided opposite to the hinges, and the mounting bases 1 are arranged between the screw plates 5 and the hinges. The hinges are mounted on the mounting bases 1 through the screw plates 5, so that the mounting of the hinges are stable and reliable. Wherein, referring to FIG. 9, a through hole 16 is provided on the mounting bases 1, a plurality of screw holes are provided in the screw plates 5, the through hole 16 is concentric with the screw hole, and a screw on the hinges are mounted on the screw hole through the through hole 16.

In a preferred embodiment, the through hole 16 in the mounting bases 1 can be sealed with a sealing tape before the refrigerator body is foamed, so that the foaming material is prevented from leaking out through the through hole 16, and when the hinges are mounted, the sealing tape is punctured by a screw on the hinges to be mounted on the screw hole.

Figure 8:
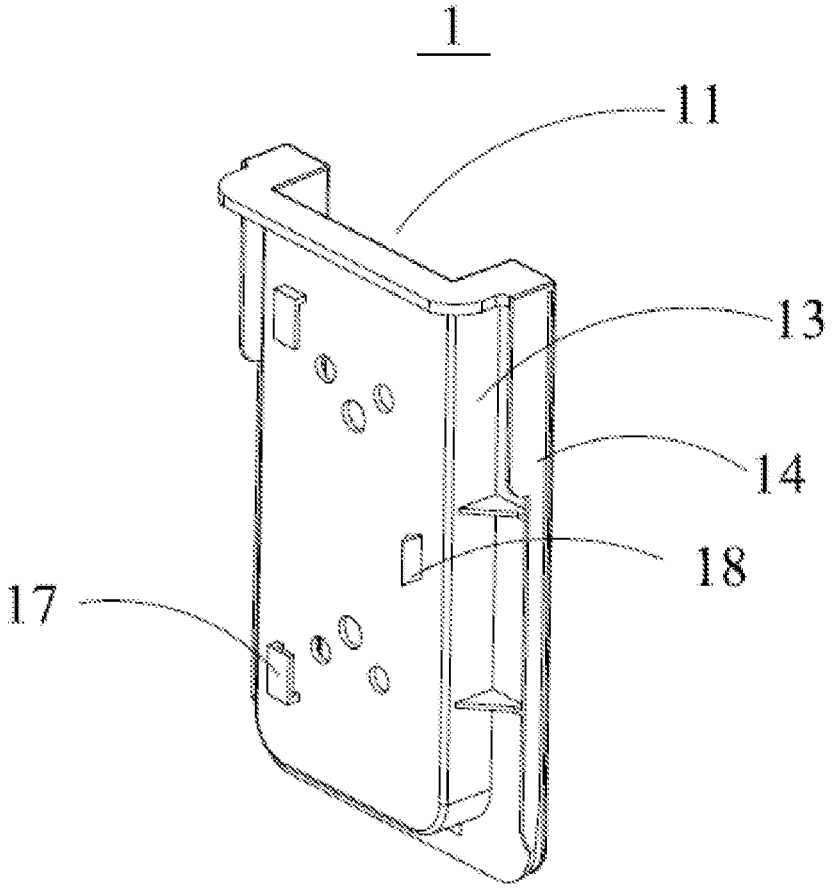
FIG. 8 is a schematic view showing the structure of the mounting bases from one perspective in the embodiment of the present application.

Further, referring to FIG. 8, two oppositely provided positioning grooves 17 are provided on the surface of the mounting bases 1 facing the screw plates 5, and the screw plates 5 are inserted into the two positioning grooves 17. The positioning grooves 17 positions the mounting position of the screw plates 5, so that the mounting of the screw plates 5 is more convenient.

Wherein, referring to FIG. 8, a plurality of buckles 18 are further provided on the surface of the mounting bases 1 facing the screw plates, the buckles 18 and the two positioning grooves 17 are provided at intervals, and the screw plates 5 are clamped on the buckles 18. The screw plates 5 are firmly connected with the mounting bases 1 through the cooperation of the positioning grooves 17 and the buckles 18. In addition, the application also provides a refrigerator, the refrigerator comprises a door body, a plurality of hinges and a refrigerator box body described above which is connected with the door body, the hinges are mounted on the mounting bases 1. The box housing of the refrigerator adopts a design of depression, the mounting bases are mounted in the side plate of the box housing, and the hinges are mounted in the depressions of the mounting bases, so that the space on the outer surface of the box housing occupied by the hinges after being mounted on the mounting bases are reduced, the loading quantity of products is improved, and the transportation cost is reduced.

The above description is merely a preferred embodiment of the present application, and is not intended to limit the scope of the present application, under the application concept of this application, any equivalent structural transformations made using the content of the description and drawings of this application, or directly/indirectly applied in other related technical fields are included in the scope of patent protection of this application.

What is claimed is:

1. A refrigerator box body, comprising:

a mounting base configured to mount a hinge;

a box housing including an upward opening; and an opening frame coupled to the opening of the box housing, wherein a side plate of the box housing includes a mounting port penetrating the side plate of the box housing along a thickness direction, the mounting base is arranged within the mounting port, the mounting base includes a depression with a concave side of the depression facing an inside of the box housing, the hinge is mounted within the depression, the mounting base is provided with guide grooves, side edges of the mounting port are inserted into the guide grooves to couple the mounting base and the box housing, and an edge of the opening frame abuts against an upper side of the mounting base.

2. The refrigerator box body of claim 1, wherein the mounting base comprises a mounting housing and mounting plates provided on left and right sides of the mounting housing, the depression is provided on the mounting housing, the guide grooves are provided in the mounting plates, and side edges of the mounting port are inserted into the guide grooves to couple the mounting base and the box housing.

3. The refrigerator box body of claim 2, wherein the opening frame includes a notch facing the mounting port, both sides of the notch extend downward to form a wrapping, and the wrapping covers an upper side of the mounting base.

4. The refrigerator box body of claim 2, further comprising a screw plate connected to the mounting base, wherein the screw plate is provided opposite to the hinge, and the mounting base is arranged between the screw plate and the hinge.

5. The refrigerator box body of claim 2, wherein a plurality of boss structures are provided at intervals in the guide grooves, the boss structures are provided in the mounting plate, a length direction of the boss structures is consistent with a height direction of the guide grooves, and protrusions of the boss structures face away from the inside of the box housing.

6. The refrigerator box body of claim 2, wherein the mounting base further comprises a clamping plate provided at a lower side of the mounting base, a plurality of slots are provided in the clamping plate, and lower edges of the mounting port are inserted into the slots.

7. The refrigerator box body of claim 6, wherein inverted buckles are provided in the plurality of slots, and clamping holes which are clamped with the inverted buckles are provided on the lower edge of the mounting port.

8. The refrigerator box body of claim 1, wherein the opening frame includes a notch facing the mounting port, both sides of the notch extend downward to form a wrapping, and the wrapping cover an upper side of the mounting base.

9. The refrigerator box body of claim 1, wherein the box body further comprises a screw plate coupled to the mounting base, the screw plates is positioned opposite to the hinge, and the mounting base is arranged between the screw plate and the hinge.

10. The refrigerator box body of claim 9, wherein two positioning grooves are oppositely provided on a surface of the mounting base facing the screw plate, and the screw plates are inserted into the two positioning grooves.

11. The refrigerator box body of claim 10, wherein a buckle is further provided on the surface of the mounting base facing the screw plate, the buckle and the two positioning grooves are provided at intervals, and the screw plate are clamped on the buckles.

12. A refrigerator, comprising a door body, a hinge and a refrigerator box body coupled to the door body, wherein the hinge is mounted on a mounting base, the refrigerator box body includes the mounting base configured to mount the hinge, a box housing including an upward opening, and an opening frame connected to the opening of the box housing, a side plate of the box housing includes a mounting port penetrating a side plate of the box housing along a thickness direction, the mounting base is arranged within the mounting port, the mounting base includes a depression with a concave side of the depression facing an inside of the box housing, the hinge is mounted within the depression, the mounting base includes guide grooves, side edges of the mounting port are inserted into the guide grooves to couple the mounting bases and the box housing, and an edge of the opening frame abuts against an upper side of the mounting base.

13. The refrigerator of claim 12, wherein the mounting base comprises a mounting housing and mounting plates provided on left and right sides of the mounting housing, the depression is provided on the mounting housing, the guide grooves are provided in the mounting plate, and side edges of the mounting port are inserted into the guide grooves to couple the mounting bases and the box housing.

14. The refrigerator of claim 13, wherein a plurality of boss structures are provided at intervals in the guide grooves, the boss structures are provided in the mounting plates, a length direction of the boss structures is consistent with a height direction of the guide grooves, and protrusions of the boss structures face away from the inside of the box housing.

15. The refrigerator of claim 13, wherein the mounting base further comprises a clamping plate provided at a lower side of the mounting base, a plurality of slots are provided in the clamping plate, and lower edges of the mounting port are inserted into the slots.

16. The refrigerator of claim 15, wherein inverted buckles are provided in the slots, and clamping holes that are clamped with the inverted buckles are provided on a lower edge of the mounting port.

17. The refrigerator of claim 12, wherein the opening frame includes a notch facing the mounting port, both sides of the notch extend downward to form a wrapping, and the wrapping covers an upper side of the mounting base.

18. The refrigerator of claim 12, further comprising a screw plate coupled to the mounting base, wherein the screw plate is arranged opposite to the hinge, and the mounting base is arranged between the screw plate and the hinge.

19. The refrigerator of claim 18, wherein two positioning grooves are oppositely provided on a surface of the mounting base facing the screw plate, and the screw plate is inserted into the two positioning grooves.

20. The refrigerator of claim 19, wherein a buckle is further provided on the surface of the mounting base facing the screw plate, the buckle and the two positioning grooves are provided at intervals, and the screw plate is clamped on the buckle.

* * * * *